US005551239A

United States Patent [19]

Feeley et al.

[11] Patent Number: 5,551,239

[45] Date of Patent: Sep. 3, 1996

[54] CATALYTIC COMBUSTION SYSTEM INCLUDING A SEPARATOR BODY

[75] Inventors: Jennifer S. Feeley, Clinton; James C. Fu, Plainsboro; Matthew P. Larkin, Cranbury; Dianne O. Simone, Edison, all of N.J.

[73] Assignee: Engelhard Corporation, Iselin, N.J.

[21] Appl. No.: 271,244

[22] Filed: Jul. 7, 1994

Related U.S. Application Data

[63] Continuation of Ser. No. 24,707, Mar. 1, 1993, abandoned.

[51] Int. Cl.[6] ..... F02C 3/00

[52] U.S. Cl. ..... 60/723

[58] Field of Search ..... 60/723, 39.822; 431/7, 170, 328; 502/527, 303; 423/213.2, 213.5

[56] References Cited

U.S. PATENT DOCUMENTS

| | | | |
|---|---|---|---|
| 3,056,646 | 1/1963 | Cohn | 431/2 |
| 3,857,668 | 12/1974 | Koch | 60/723 |
| 3,928,961 | 12/1975 | Pfefferle | 60/39.02 |
| 4,019,316 | 4/1977 | Pfefferle | 60/723 |
| 4,065,917 | 3/1978 | Pfefferle | 60/723 |
| 4,154,568 | 5/1979 | Kendall et al. | 431/7 |
| 4,202,168 | 5/1980 | Acheson et al. | 60/723 |
| 4,270,896 | 6/1981 | Polinski et al. | 431/328 |
| 4,378,949 | 3/1983 | Salooja | 431/170 |
| 4,856,271 | 8/1989 | Burke | 60/723 |
| 4,870,824 | 10/1989 | Young et al. | 431/328 |
| 4,916,105 | 4/1990 | Rieck et al. | 502/303 |
| 4,919,902 | 4/1990 | Bricker et al. | 423/213.5 |
| 5,000,004 | 3/1991 | Yamanaka et al. | 431/7 |
| 5,047,381 | 4/1991 | Beebe | 423/213.5 |
| 5,079,064 | 1/1992 | Forsythe | 501/118 |
| 5,102,639 | 4/1992 | Chou et al. | 423/263 |
| 5,192,515 | 3/1993 | Gardner-Chavis et al. | 423/213.2 |

FOREIGN PATENT DOCUMENTS

| | | | |
|---|---|---|---|
| 59-46423 | 3/1984 | Japan | F23R 3/40 |
| 59-142332 | 8/1984 | Japan | F23R 3/40 |
| 59-225211 | 12/1989 | Japan | F23D 3/18 |
| 9209848 | 6/1992 | WIPO . | |
| 9209849 | 6/1992 | WIPO . | |
| 9209365 | 6/1992 | WIPO . | |

*Primary Examiner*—Timothy S. Thorpe

[57] ABSTRACT

A combustor for supporting the catalytic combustion of gaseous carbonaceous fuel contains a catalyst zone in which is disposed a catalyst body comprising at least one catalyst member, a separator zone comprising a separator body and a downstream zone where homogeneous combustion occurs. The catalyst member contains a carrier and a catalyst material deposited thereon. The catalyst body may, optionally, contain additional catalyst members downstream of the at least one catalyst member. The separator body contains a carrier-type monolith containing ceramic fibers in a matrix. One of the optional additional catalyst members may also contain such a monolith on which the catalyst composition is disposed.

21 Claims, 14 Drawing Sheets

CATALYTIC COMBUSTION SYSTEM INCLUDING A SEPARATOR BODY

This is a continuation of application Ser. No. 08/024,707, filed Mar. 1, 1993, now abandoned.

BACKGROUND OF THE INVENTION

1. Field of the Invention

The present invention relates to an apparatus and process for the catalytically supported combustion of gaseous carbonaceous materials, including natural gas and methane. In a more specific aspect, this invention relates to an apparatus and process for catalytically supported combustion of natural gas or methane using a supported palladium oxide catalyst.

2. Description of Related Art

Catalytically supported combustion processes have been described in the prior art, e.g., see U.S. Pat. No. 3,928,961 to Pfefferle and U.S. Pat. Nos. 4,065,917 and 4,019,316. The use of natural gas or methane in catalytic combustion has been taught in the art, as has the use of a palladium catalyst to promote such combustion oxidation. See U.S. Pat. No. 3,056,646 to Cohn, wherein the use of palladium catalyst to promote methane oxidation is disclosed, as is an operable temperature range of 271° C. to 900° C. (see column 2, lines 19–25).

U.S. Pat. No. 4,154,568 to Kendall et al, dated May 15, 1979 discloses a catalyst bed design comprising a plurality of carrier monoliths in the flow stream of the air/fuel mixture, wherein the channel size in respective monoliths decreases progressively for monoliths at progressively downstream positions, to provide substantially complete combustion in the catalyst bed (see column 1, lines 47–59).

SUMMARY OF THE INVENTION

The present invention provides a combustor for catalytically promoting thermal combustion of an inlet combustion gas mixture flowed sequentially through an upstream zone and then a downstream zone of the combustor. The combustor comprises a catalyst body disposed in the upstream zone and comprising at least one catalyst member comprising a carrier having a plurality of gas flow channels extending therethrough defined by channel walls. The channel walls of the carrier have disposed thereon a catalyst composition effective for promoting combustion of the combustion gas mixture. There is also a separator body, disposed in the upstream zone in a position downstream of the catalyst body. A homogeneous reaction zone is disposed within the downstream zone. The separator body is dimensioned and configured to thermally shield the catalyst body from the homogeneous reaction zone.

According to one aspect of the invention, the catalyst body and the separator body may together comprise a single, monolithic body.

Another aspect of the invention provides that the catalyst body and the separator body may comprise discrete bodies disposed in proximity to each other or in mutual abutting relation to one another. The catalyst body and the separator body may be of substantially identical cross-sectional area and configuration.

Yet another aspect of the invention provides that the catalyst composition of the catalyst body may comprise a palladium oxide catalyst composition. The palladium oxide catalyst composition may comprise palladium oxide dispersed on a refractory inorganic oxide support, such as alumina or alumina impregnated with a rare earth oxide.

The catalyst body many comprise a plurality of catalyst members, and the respective catalyst compositions thereon may be different from, or the same as, one another. On the other hand, the separator body is preferably, but not necessarily, substantially free of a metal-containing catalyst, e.g., a palladium-containing catalyst, effective for catalytically promoting thermal combustion of the inlet combustion gas mixture. Thus, the separator body, if it has a coating thereon, may be coated with alumina. The coating on the separator body may comprise a palladium containing material that is substantially inactive for the combustion of the combustion gas mixture under normal separator body operating conditions, e.g., the coating may comprise a binary oxide of a rare earth metal, e.g., lanthanum and palladium.

In preferred embodiments of the present invention, the catalyst body may comprise a plurality of catalyst members. The catalyst members may be disposed in abutting contact, or in proximal relation to one another. The catalyst members and the separator body may have from about 9 to about 400 gas flow channels per cross-sectional square inch ("cpsi"). The total combined length of the catalyst members may be from about ½ to 12 inches, and the length of the separator body may be from about ½ to 5 inches.

According to still another aspect of the present invention, the separator body may comprise a silica-magnesia-alumina material comprised primarily of cordierite, mullite and corundum. The silica-magnesia-alumina material may comprise from about 20 to 40 weight percent $SiO_2$, from about 3 to 6 weight percent MgO and from about 54 to 77 weight percent $Al_2O_3$. About 50 to 90 percent by weight of each of said $SiO_2$, MgO and $Al_2O_3$ may comprise crystalline material, the balance comprising amorphous material. The crystalline material typically comprises about 15 to 40 percent by weight cordierite, about 15 to 35 percent by weight corundum and about 10 to 30 percent by weight mullite, based on the weight of the carrier. Alternatively, the separator body may comprise a ceramic fiber matrix material comprising ceramic fibers, the composition of which comprises alumina, boron oxide and silica, the fibers being fixed in a silicon carbide matrix. The fibers of the ceramic fiber matrix material may comprise, for example, about 64 percent alumina, 14 percent $B_2O_3$ and 24 percent $SiO_2$.

As used herein and in the claims, the terms "upstream" and "downstream" refer to the relative placement of elements sensed in the direction of flow of the combustion mixture through a catalyst apparatus according to the invention.

DETAILED DESCRIPTION OF THE INVENTION AND SPECIFIC EMBODIMENTS THEREOF

Figure 1:
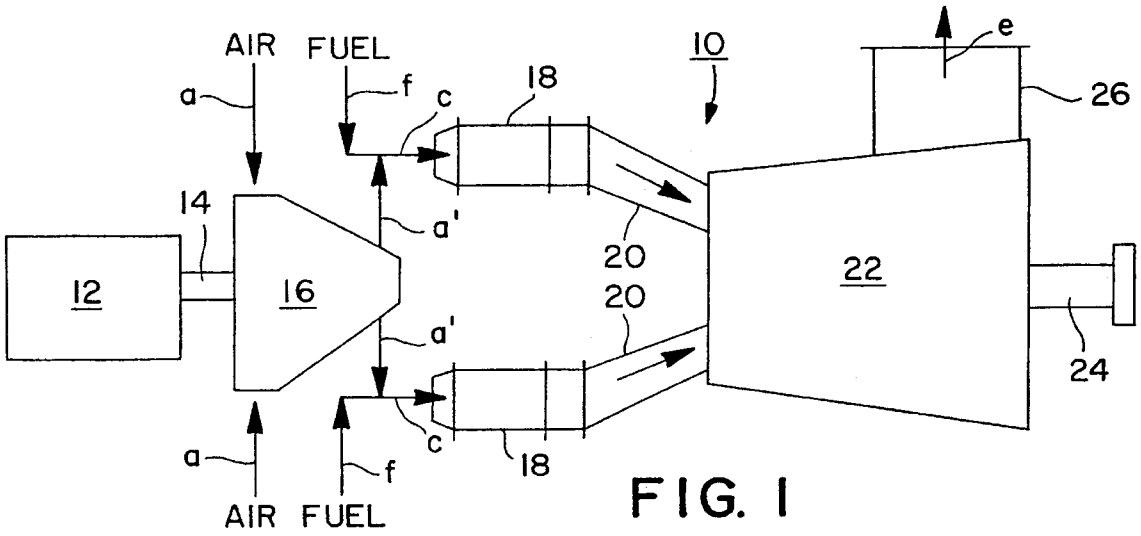
FIG. 1 is a schematic plan view of a gas turbine unit utilizing catalytic thermal combustors in accordance with one aspect of the present invention.

Burning of carbonaceous fuels is associated with formation of air pollutants, among the most troublesome of which are nitrogen oxides ($NO_x$). Nitrogen oxides form whenever air-supported combustion takes place at open-flame temperatures. One approach to eliminating nitrogen oxides involves catalytic post-treatment to reduce $NO_x$ to nitrogen. A more economical method is to operate the combustion process catalytically, at a temperature lower than open-flame temperatures.

It has long been realized that little or no $NO_x$ is formed in such a system. Typically, such catalytic combustion of natural gas or methane, for example, utilizes a preburner or thermal combustor which employs flame combustion to preheat combustion air to a temperature of 350° C. or higher. Once the catalyst is sufficiently hot to sustain catalysis, the preburner is shut down and all the fuel and air are directed to the catalyst. Such a catalytic combustor, if operated at temperatures below about 1300° C. to 1500° C., avoids or at least controls to acceptable levels the $NO_x$ formation which occurs at the higher temperatures which are characteristic of the flame combustion. However, such catalytic combustion which will function effectively at a high space velocity has heretofore been generally regarded as commercially unattractive. Reasons for this lack of commercial attractiveness include the difficulty of economically combusting methane, the principal component of natural gas, and the deactivation and instability of the catalyst compositions employed, especially in the high-temperature end of the catalyst bed where severe high temperatures may be reached. Because of the susceptibility of the catalyst to such thermal deactivation, many catalytic combustor designs are limited with respect to the type and amount of fuel they can combust in order to avoid deleterious high temperatures.

The present invention serves, in a broad aspect, to alleviate catalyst failures by providing a thermal buffer or separator body disposed between the catalyst body and a downstream zone where high temperature homogeneous combustion occurs. The separator body comprises a monolith which is preferably similar in configuration to the carrier substrates described below for catalyst materials, i.e., it may take the form of a honeycomb monolith having a plurality of parallel gas flow passages extending therethrough. The separator body may be made of any material that can withstand exposure to the high temperatures produced by the homogeneous combustion that occurs in the neighboring downstream zone of the combustor.

Due to its placement between the catalyst zone and the downstream zone where homogeneous combustion occurs, the separator body at least partially insulates the catalyst body from the heat released by the homogeneous combustion reaction. Preferably, but not necessarily, the separator body does not comprise catalytically active materials, since such materials tend to be runetable to deactivation when exposed to the temperatures that the separator body may sometimes experience. Further, catalytic material may accelerate the combustion reaction in the separator zone, thus generating additional heat at a point so near the catalyst zone as to exacerbate the risk of exposing the catalyst materials in the catalyst zone to excessive temperatures. Therefore, the use of non-catalytic separator body reduces the likelihood of thermal deactivation of the catalyst body in the catalyst zone. The separator body is disposed on the downstream side of the catalyst body, either in abutting relation thereto or in close proximity thereto sufficiently close so that the channeled flow of gases through the catalyst body is substantially preserved as channeled flow through the separator body.

One type of separator body able to withstand the high temperatures that prevail in the nearby homogeneous combustion zone is available in the form of a honeycomb-type monolith from the Minnesota Mining and Manufacturing Co. (3M) under the trade designation "Siconex." These monolith substrates are described by the manufacturer as being formed from a series of layers of woven alumina-boria-silica inorganic fibers. The thus formed monolith is then coated with silicon carbide in a vapor deposition process which is believed to enclose the fibers in a silicon carbide matrix. A surface layer of silica is believed to form on the silicon carbide matrix when the monolith is calcined. Surprisingly, these monoliths have been found to exhibit better long-term thermal strength than more conventional monoliths. The 3M Company provided an assay of its Siconex monolith, which describes the monolith as comprising about 70% silicon carbide and about 30% NEXTEL™ 312 ceramic fibers. The NEXTEL™ 312 ceramic fibers are described as comprising an alumina-boria-silica material comprising 62 weight percent $Al_2O_3$, 14 weight percent $B_2O_3$ and 24 weight percent $SiO_2$. As will be discussed below, Siconex-type substrates can sometimes be used as carriers for catalyst materials to provide a catalyst member in a catalyst zone, and in such use are referred to herein as Type II carriers to distinguish from more conventional carriers referred to as Type I carriers, as described below.

Optionally, a honeycomb monolith-type separator body may be coated with a coating comprising a refractory inorganic oxide, e.g., alumina. Other refractory oxides may be used as well and are known in the art, such as zirconia, titania, ceria, etc., and mixtures thereof. Like the catalyst member, which may, as discussed below, comprise one or more carrier monoliths, the separator body may also comprise one or more monoliths each of which may have a catalytically inert coating thereon. In other embodiments, the coating on the separator body monolith may comprise catalytically active species.

Within the catalyst zone upstream of the separator body is disposed a catalyst body comprising at least a first catalyst member comprising a carrier coated with a catalyst material. Generally, the catalyst material comprises a catalytically active metal or metal oxide, typically a platinum group metal or metal oxide such as palladium oxide, dispersed on a refractory metal oxide support material such as alumina. The choice of catalyst material may be guided by the type of fuel being combusted. As suggested above, natural gas is a common fuel, but the present invention finds utility in processes for combusting other fuels as well, e.g., number 2 fuel oil, jet fuel, normally liquid hydrocarbon fuels, alcohols, e.g., methanol, oxygenated hydrocarbons, and even hydrogen, which may be reacted with carbon monoxide. In addition, the expected operating conditions of the combustor may also be taken into account in choosing catalysts. Catalyst materials may be formed as a slurry and thus deposited onto the carrier monoliths in a process well known in the art. As will be discussed below, the catalyst zone may comprise a plurality of catalyst members, each of which may comprise the same or different catalytic materials. The catalyst members of the catalyst body are adapted to initiate in the catalyst zone catalytically-supported, i.e., heterogeneous, combustion at the surfaces thereof and to support thermal flame, i.e., homogeneous, temperature combustion in the downstream zone.

Typical catalyst materials for the combustion of natural gas include palladium oxide as the active component, with the palladium oxide dispersed on a support material comprising a relatively inert refractory inorganic oxide such as alumina, which is optionally impregnated with stabilizers, promoters or other additives. Other support materials such as silica, titania, unimpregnated zirconia, zirconia impregnated with a rare earth metal oxide, ceria, co-formed rare earth metal oxide-zirconia and combinations thereof may also be employed. The palladium oxide is dispersed on the support material in a conventional manner, e.g., by impregnating particles of the support material with a solution of a soluble palladium compound and then calcining the impregnated material. The support materials may be stabilized against thermal degradation, e.g., by the impregnation of stabilizing species, to provide a catalyst material better suited for use at a relatively downstream position in the catalyst zone. Further still, alternative active components may be employed, such as binary oxides of palladium and rare earth metals as disclosed in co-pending, commonly assigned U.S. Pat. No. 5,378,142, filed Apr. 12, 1991 and copending, commonly assigned U.S. Pat. No. 5,102,639, filed Apr. 12, 1991, the disclosures of which are hereby incorporated herein by reference. These binary oxides may result from the solid state reaction of palladium oxide with the rare earth metal oxides, to produce, e.g., $Sm_4PdO_7$, $Nd_4PdO_7$, $Pr_4PdO_7$ or $La_4PdO_7$. Such alternative active components are typically admixed with a refractory metal oxide binder to bind the material to the carrier. Other catalyst materials known in the art may be used as well.

The carrier on which the catalyst composition is carried is typically a monolith having a plurality of fine gas flow passages extending therethrough, to provide a honeycomb-type structure. The gas flow passages (sometimes referred to as "cells") in the honeycomb structure are substantially parallel and defined by thin walls, and may be of any desired cross section such as square, rectangular, triangular or hexagonal shape. The number of channels per square inch of face surface, i.e., per cross-sectional square inch (cpsi), may vary, depending upon the particular application for which the catalyst bed is to be used. Such honeycomb-type carriers are commercially available having anywhere from about 9 to 600 or more cpsi. The substrate or carrier monolith desirably is porous and may (but need not) be relatively catalytically inert to the combustion reaction as compared to the active layers used in the invention.

The carrier used in a catalyst body of the present invention should be refractory in nature, i.e., able to withstand thermal shock caused by the sudden increase or decrease in temperature experienced at start-up and shut-down of the combustor. The carrier should also have good thermal strength so that it does not develop structural flaws at the operating temperatures of the combustor, i.e., temperatures as high as 1500° C. Conventional cordierite monoliths such as those used to support three-way catalysts for treating the exhaust gases of automotive internal combustion engines are generally not considered to be suitable in combustors of the present invention because they can melt or otherwise fail at combustor operating temperatures. Suitable carriers may comprise a combination of cordierite and other oxide materials, e.g., a mixture of alumina, mullite and cordierite. Such carriers have physical properties more suited to combustor operation than conventional ceramic substrates, typically used to carry catalysts used in the treatment of automotive exhaust gases, i.e., they exhibit better thermal strength and thermal shock resistance, and are commercially available, e.g., from the Dupont Company under the designation PRD-66. An elemental analysis of this material provided by the Dupont Company describes the material containing 70.4 weight percent $Al_2O_3$, 24.9 weight percent $SiO_2$ and 4.2 weight percent MgO. However, another analysis resulted in proportions of about 62.7–63.4 weight percent $Al_2O_3$, 31.2–31.3 weight percent $SiO_2$ and 5.4–5.7 weight percent MgO. Approximately 50 to 90 percent by weight of each of the $SiO_2$, MgO and $Al_2O_3$ may comprise crystalline material, the balance comprising amorphous material. Typically, the crystalline material comprises 15 to 40 percent cordierite, 15 to 35 percent corundum and 10 to 30 percent mullite by weight of the carrier. A further description of this material may be found in U.S. Pat. No. 5,079,064, the disclosure of which is hereby incorporated herein by reference. Carriers comprising such materials are sometimes referred to herein as Type I carriers.

As indicated above, the catalyst body may comprise more than one catalyst member. In one perferred embodiment, it may be desired to emplace catalyst members having different catalyst materials in the catalyst zone in a sequence suited to the temperature conditions of operation of the combustor. Co-pending, commonly assigned U.S. Pat. No. 5,474,441, filed on Feb. 25, 1993 teaches how catalyst members may be sequenced according to temperature-related characteristics of catalyst materials disposed thereon, and the disclosure of that application is hereby incorporated herein by reference. Briefly re-stated, the cited patent application teaches that catalyst materials should be disposed in relative upstream-downstream relation in order of at least one of decreasing catalytic activity, increasing thermal stability (i.e., escalating degradation temperature) or escalating and preferably overlapping regeneration temperature ranges. In another preferred embodiment, the catalyst body comprises two catalyst members, both comprising a catalyst material comprising PdO dispersed on a support material comprising alumina impregnated with rare earth oxide, e.g., ceria. The carriers for these catalyst members are Type I carriers. Preferably, the separator body comprises two Type II monoliths.

Preferably, the first catalyst member, each optional additional catalyst member and the separator body are discrete bodies within the combustor. For example, the first catalyst member will preferably comprise the first catalyst composition disposed on the first carrier and the second catalyst member will likewise comprise the second catalyst composition on a separate second carrier. Then, the first catalyst member and the second catalyst member may be disposed within the combustor in adjacent, optionally abutting, upstream/downstream relation to one another. The catalyst members may be disposed with their respective gas flow channels in mutual alignment so that the flow of combustion gases through the first catalyst member will be channeled into the second catalyst member. The first catalyst member and the second catalyst member may be formed on a single, integral monolith by applying a coating of the first catalyst composition on one end of the monolith and a coating of the second catalyst composition on the other end of the monolith. The separator body preferably also comprises a discrete refractory body having a plurality of gas flow channels extending therethrough and has a cross-sectional area and configuration substantially identical to that of the adjacent catalyst member and is aligned in this manner as well. In other embodiments of the invention, the separator body and a downstream catalyst body may together comprise a single monolith, e.g., a Type II monolith, one end of which is coated with a catalyst material to form the catalyst body, the other end of which is preferably either uncoated or is coated with a relatively inert, i.e., non-platinum group metal-bearing, coating.

Referring now to FIG. 1 there is shown in schematic plan view a gas turbine 10 comprising a starter engine 12 connected by an engine shaft 14 to an air compressor 16, which is provided with inlet air, via air inlet lines indicated by arrows a, which is compressed by compressor 16 and discharged via lines a' into combustion gas inlet lines c which are also supplied with a pressurized gaseous fuel, such as natural gas or methane, via gas inlet lines indicated by arrows f. The air and fuel combine to form a combustion mixture which is introduced via lines c into a plurality of catalytic thermal combustors 18, two of which are illustrated in FIG. 1 although it will be appreciated that any suitable number may be employed. For example, eight such combustors 18 may be utilized with their outlets disposed equiradially about the inlet to the turbine. Each catalytic thermal combustor 18 is provided with an associated outlet duct 20 connected in gas flow communication with a turbine 22 which may comprise a multi-staged turbine as well known to those skilled in the art. Turbine 22 is drivingly connected to a load coupling shaft 24 to connect the turbine output to a suitable device, for example, an electric generator. The expended combustion products are exhausted as shown by arrow e via exhaust stack 26 for discharge to the atmosphere or for further use or processing.

Figure 2:
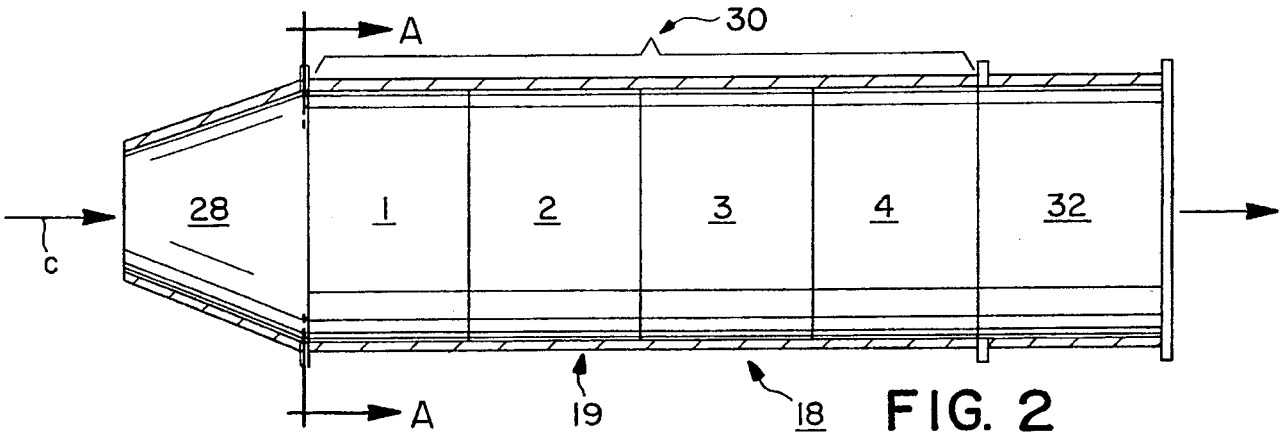
FIG. 2 is a schematic longitudinal cross-sectional view of one of the catalytic thermal combustors of FIG. 1 showing four cylindrical catalyst members arranged therein.

FIG. 2 shows a schematic cross-sectional view of a typical catalytic thermal combustor 18 comprising a cannister 19 having an inlet section 28, an upstream zone 30 wherein is disposed a catalyst body comprising catalyst members 1, 2, and 3 and a separator body 4, and a downstream zone 32. The three catalyst members 1, 2, and 3, and separator body 4 are arranged in abutting contact. That is, catalyst members 1 and 2 are positioned in face-to-face abutting contact, as are catalyst members 2 and 3. Separator body 4 is in abutting contact with catalyst member 3. Generally, the catalyst members 1, 2, and 3 each comprise a refractory honeycomb monolith carrier. The carrier is a substantially cylindrical body (see FIG. 2A) having opposite end faces between which extend a plurality of generally parallel, fine gas flow passages. FIG. 2A shows a typical catalyst member end face 1*a* of catalyst member 1, schematically showing a plurality of fine, parallel gas flow passages extending longitudinally through catalyst member 1 to permit gas flow through catalyst member 1. This construction is typical of all the catalyst members 1 through 3 inclusively. The gas flow passages are defined by walls on which are disposed a coating (often referred to as a "washcoat") of an active material suitable to catalyze the oxidation of a gaseous fuel such as natural gas or methane.

Figure 2B:
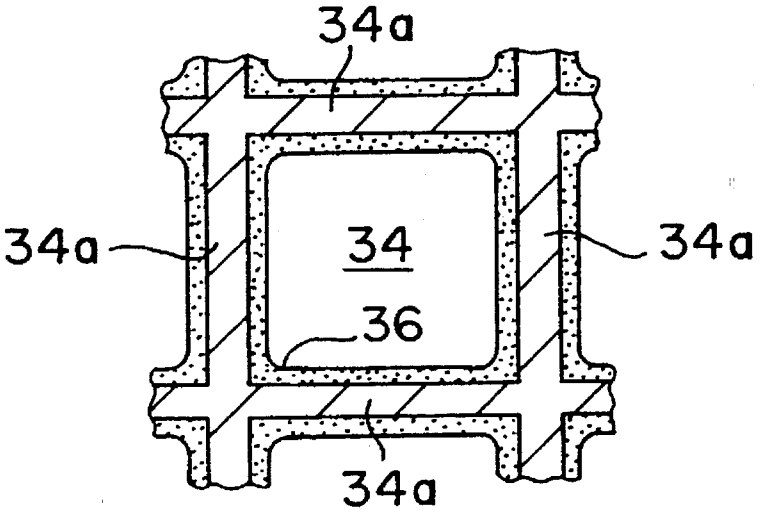
FIG. 2B is a view, greatly enlarged with respect to FIG. 2A, showing in cross section one of the gas flow channels of catalyst member 1.
Figure 2A:
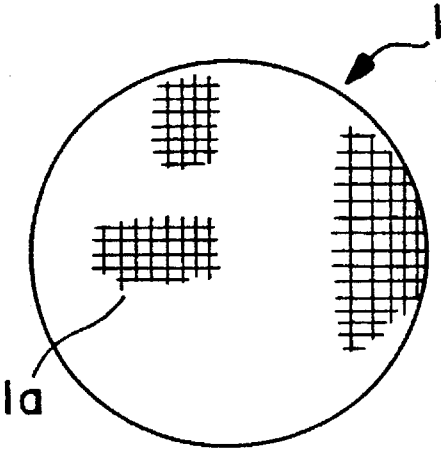
FIG. 2A is a view taken along line A—A of FIG. 2 showing a cross section of catalyst member 1 of FIG. 2.
Figure 3A:
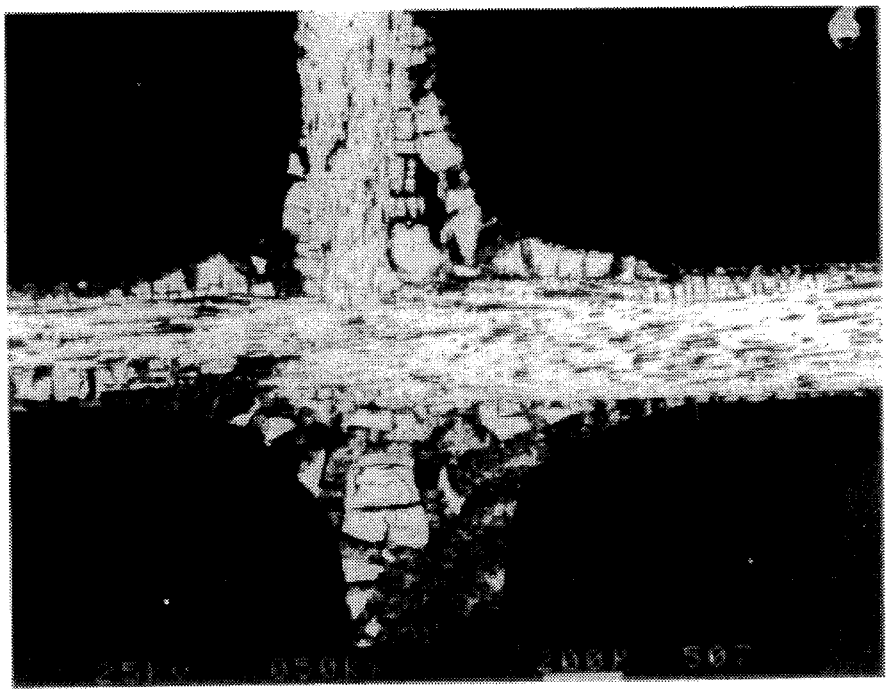
FIGS. 3A and 3B are SEM photographs of cross sections taken from the inlet and outlet ends, respectively, of segment S1 of Example 1.
Figure 3B:
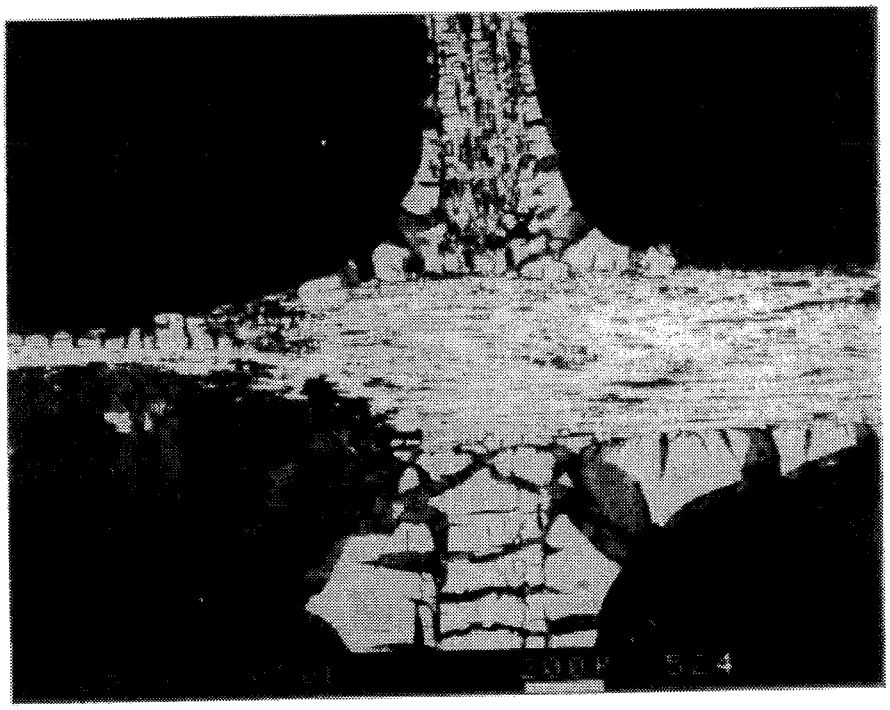
Figure 3C:
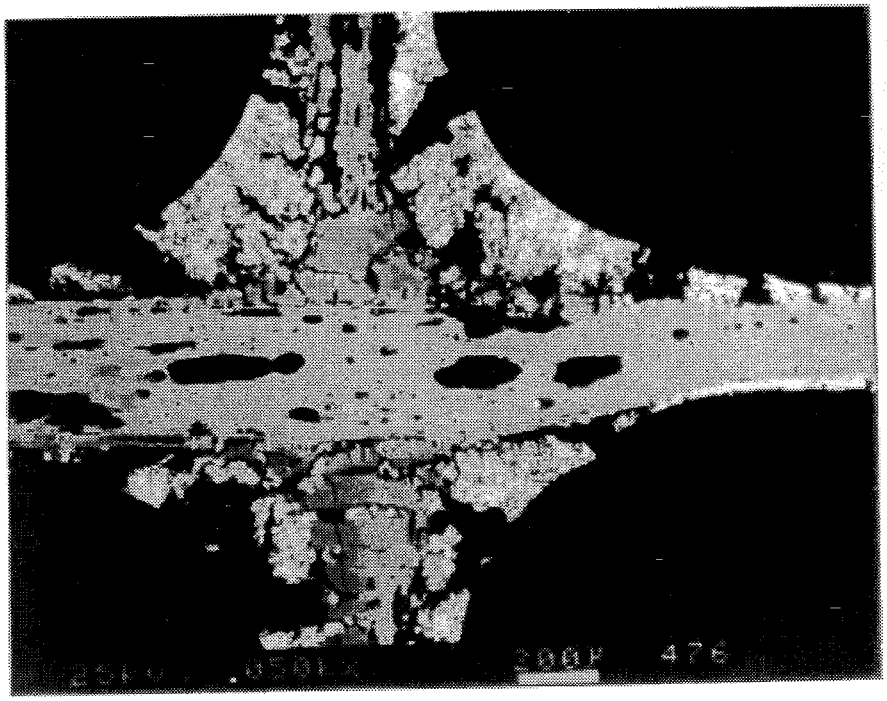
FIGS. 3C and 3D are SEM photographs of cross sections taken from the inlet and outlet ends, respectively, of spent segment S2 of Example 1.
Figure 3D:
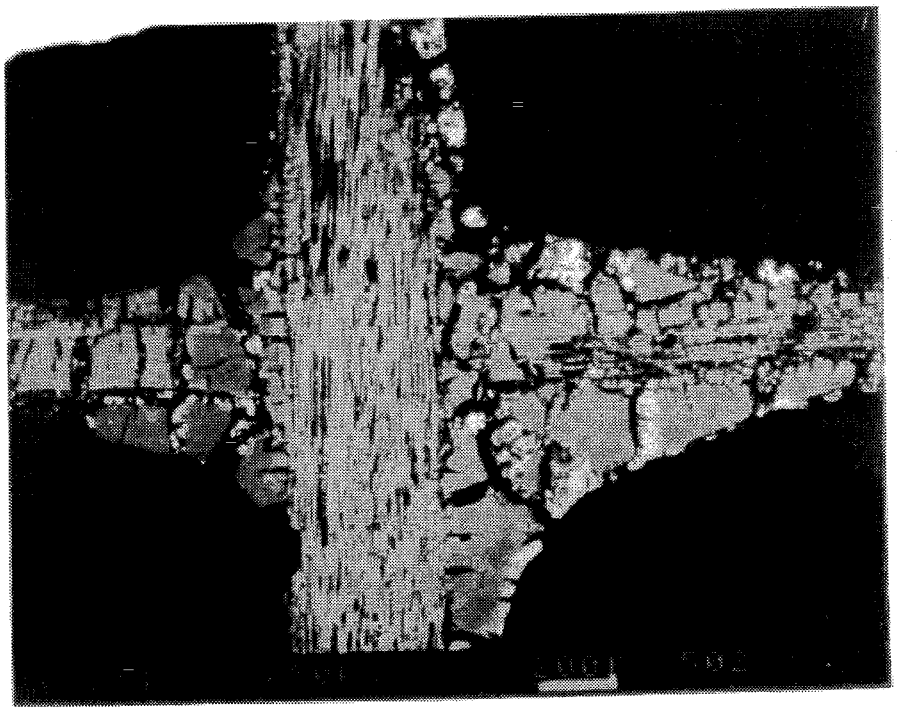
Figure 3E:
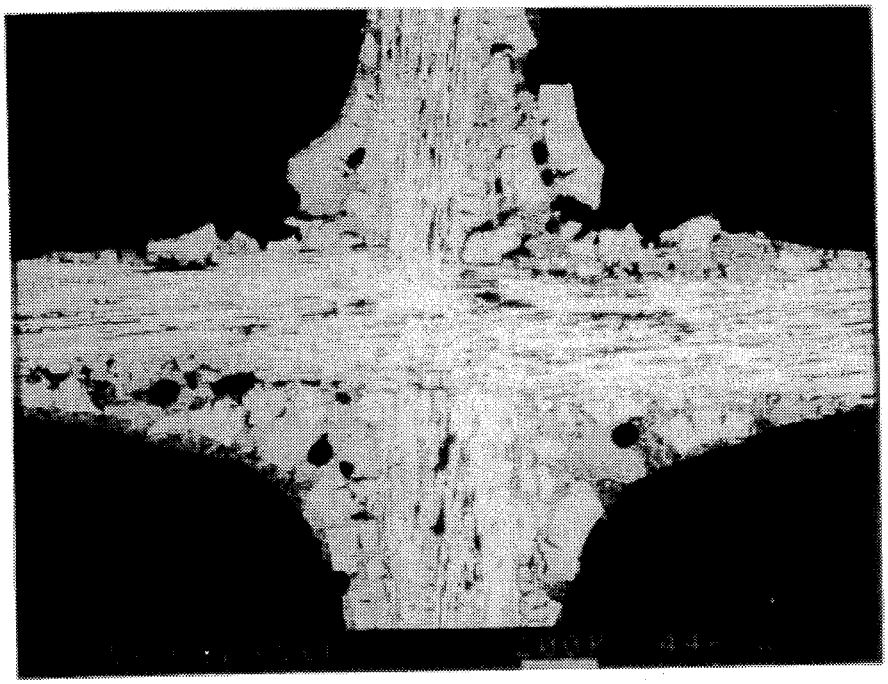
FIGS. 3E and 3F are SEM photographs of cross sections taken from the inlet and outlet ends, respectively, of segment S3 of Example 1 after aging.
Figure 3F:
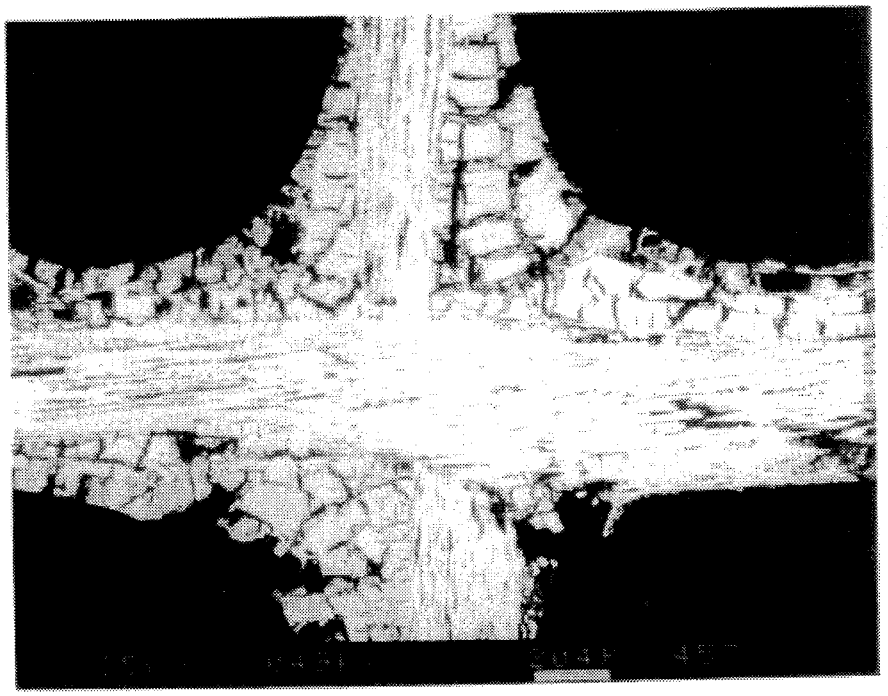
Figure 3G:
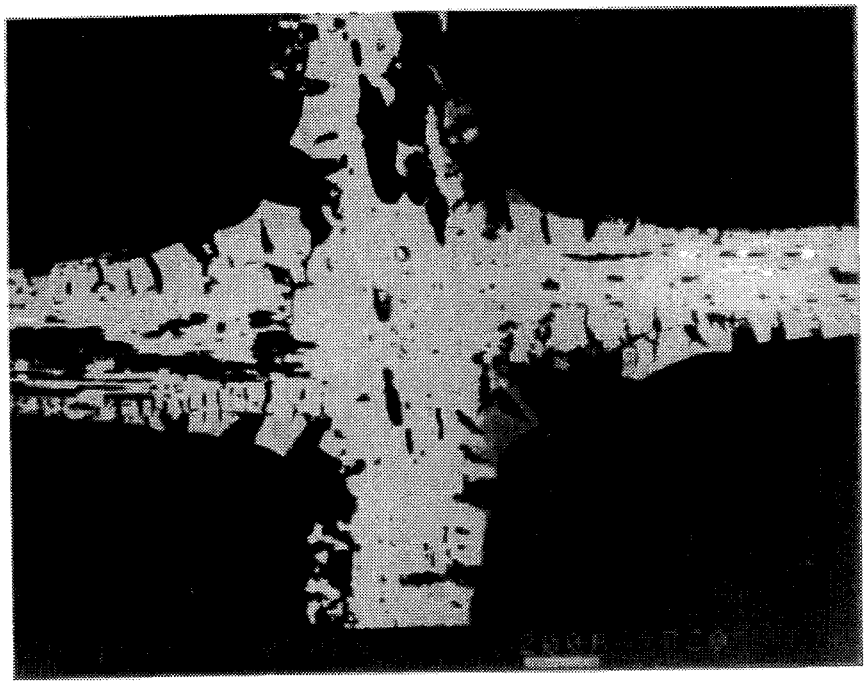
FIGS. 3G and 3H are SEM photographs of cross sections taken from segment S4 of Example 1 after aging.
Figure 3H:
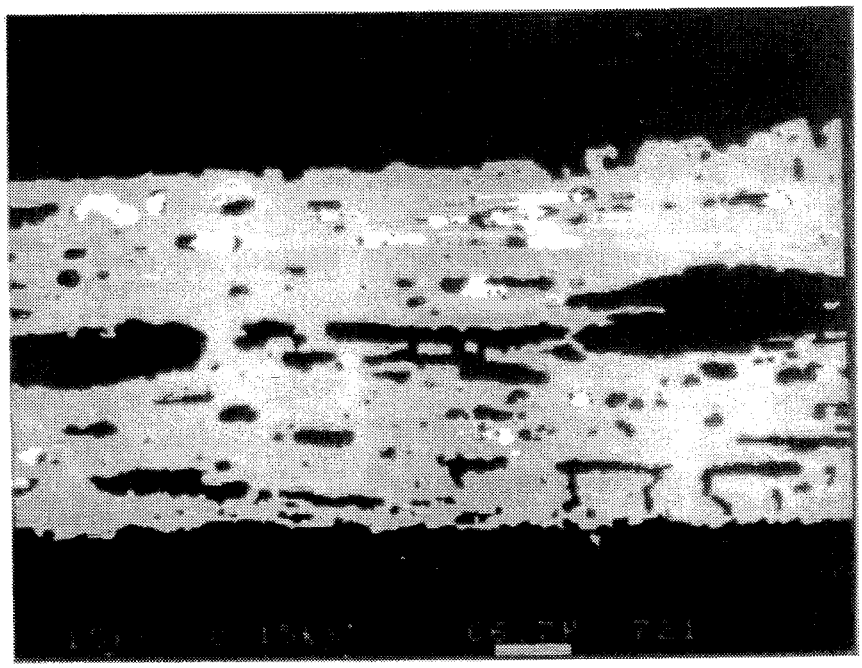

FIG. 2B shows an enlarged view corresponding to FIG. 2A in which a typical gas flow passage 34 in a catalyst member is shown in cross-sectional view as being defined by four gas flow passage walls 34*a* on which is coated a catalytic material washcoat 36. The cross-sectional configuration of gas flow passage 34 illustrated in FIG. 2B is rectangular but it will be appreciated that any suitable cross-sectional configuration may be employed such as square, polygonal, e.g., triangular, or circular. Further, the gas flow passages may have a configuration attained by alternating layers of flat and wave-form plates made of a suitable refractory material, as is well known to those skilled in the art.

Preferably, separator body 4 is dimensioned and configured to provide gas flow channels that correspond with the channels in catalyst member 3, i.e., the catalyst member against which the separator body is disposed. This allows the gas stream to maintain channeled gas flow from the catalyst member through the separator body.

EXAMPLE 1

To demonstrate the effectiveness of using a separator body according to the present invention to thermally insulate catalytically active segments upstream thereof. A catalyst bed was prepared which comprised four segments, all of which comprised Type I monoliths having 64 cells per square inch. Segments 1, 3 and 4 were each 1.5 inches long and segment 2 was 1 inch long.

Segments 1 and 2 were coated with catalyst material, which, on segment 1, comprised 4% by weight of the catalyst material palladium as palladium oxide dispersed on an alumina support. This material was prepared in a conventional manner, i.e., by impregnating activated alumina support material with a palladium salt solution and drying and calcining the impregnated alumina. Segment 2 carried a catalyst material comprising 8% by weight palladium as palladium oxide and 10% by weight cerium oxide on an alumina support. The palladium and cerium oxide were co-impregnated into the alumina by preparing a solution of cerium nitrate and palladium nitrate, impregnating the alumina with the solution, and then drying and calcining the co-impregnated alumina. Segments 3 and 4, which provide the separator body, each were coated with alumina. The washcoat loading on each segment was 1.5 grams per cubic inch. The configuration of this catalyst bed, which is designated bed S, is set forth in the Table IA below.

TABLE IA

| Catalyst Member | Catalyst Bed S: Substrate Type, | Length | Washcoat |
|---|---|---|---|
| S1 | I | 1.5" | 4 wt. % Pd on alumina |
| S2 | I | 1" | 8 wt. % Pd; 10% ceria/alumina |
| S3 | I | 1.5" | alumina |
| S4 | I | 1.5" | alumina |

The segments were placed as a catalyst bed in a combustor and was used to catalytically support the combustion of a combustion mixture comprising 4% methane in air flowing at a speed of 50 feet per second at a pressure of 3 atmospheres. Combustion was initiated and terminated 70 times and the bed ran for a total of 500 hours, igniting combustion at inlet temperatures in the range of about 480°–520° C. The gases exiting from the combustor generally contained less than 1.5 parts per million of nitrogen oxides and about 4–15 parts per million carbon monoxide. An analysis unit detected no unburned hydrocarbons. The length of the run established that the catalyst bed had sufficient durability for catalytically initiating combustion of the air/fuel mixture.

Following the 500 hour trial, the segments were separately evaluated for catalytic activity, and their respective structural integrities were examined by means of scanning electron microscopy and an energy dispersion spectroscopy (SEM/EDS). In addition, similar samples were prepared for comparison, using fresh materials.

The activity testing was performed by taking a sample core from each segment and flowing a mixture of 1% methane in air at a rate of 20 feet per second through the core sample and raising the inlet temperature of the methane/air mixture. Temperatures at which specific percentages of conversion were achieved were noted. Samples were taken from both the inlet and outlet ends of these segments. The results are set forth below in TABLE IB.

TABLE IB

| Segment | Temp. °C. @ % $CH_4$ Conversion: 10% | 20% | 30% | 40% | 50% |
|---|---|---|---|---|---|
| S1 fresh | 405 | 470 | 530 | 618 | 700 (45%) |
| spent inlet | 529 | 608 | 680 | 700 (33%) | — |
| spent outlet | 482 | 572 | 640 | 700 (37%) | — |
| S2 fresh | 375 | 401 | 462 | 590 | 700 (41%) |
| spent inlet | 450 | 538 | 642 | 700 (34%) | — |
| spent outlet | 437 | 527 | 617 | 700 (39%) | — |
| S3 fresh | 700 (2%) | — | — | — | — |
| spent inlet | 700 | — | — | — | — |
| spent outlet | 700 (8%) | — | — | — | |

The data of TABLE IB show that segments S1 and S2 suffered only minor deactivation following the 500 hour combustion run due to shielding by separator body segments S3 and S4. The apparent increase in activity of segment S3 may be attributed to palladium deposits that migrated onto segment S3 from segments S1 and S2.

The SEM/EDS examination of segment S1 revealed that the segment maintained structural integrity, showing little interaction between the washcoat and the substrate at both the inlet and outlet ends, with little washcoat loss. Segment S2 also showed little washcoat loss, but it appeared that the washcoat suffered more degradation than that of segment S1. In addition, some loss in structural integrity was evident in segment S2. SEM photos of cross-sectional segments S1, S2, S3 and S4 are shown in FIGS. 3A–3H. The photos of segment S4 show that this segment suffered greater deterioration than any other segment of the bed. These observations, taken in light of the duration of combustor operation and in conjunction with the activity data presented above, show that the separator body of the present invention is effective to thermally shield the upstream catalyst members from the deleterious high temperatures produced in the homogeneous combustion zone.

EXAMPLE 2

To illustrate the use of separator bodies according to the present invention having different compositions and to demonstrate the superior resistance to thermal degradation of catalyst members and separator bodies comprising Type II substrate, four additional catalyst beds designated bed C, bed D, bed E and bed F, each comprising four catalyst members, were prepared. TABLE IIA summarizes the respective configurations of the four catalyst beds. The catalyst materials for segments 1 and 2 in each bed in this Example were prepared in the manner described in the above Example 1. The catalyst material on members C3 and F3 comprised 7% $La_4PdO_7$ and 93% alumina as a binder. The $La_4PdO_7$ was prepared by mixing $La_2O_3$ with palladium oxide in selected weight ratios. The mixture was mechanically ground to a size range of about 50 to 100 micron diameter particles. The grinding was followed by calcination in air, for example, at a temperature of about 1100° C. for about 66 hours to provide a reaction mixture containing the binary oxide of palladium and lanthanum. Preferably, the lanthana and palladium oxide starting materials are mixed in stoichiometric proportions to produce the desired compound. Thus, the molar ratio of the lanthana to PdO in the reaction mixture may be 2:1, 1:1 or 1:2. Although it is not necessary to use the starting materials in the molar ratios of the desired binary oxide product, the use of such stoichiometric proportions has been found to be advantageous, as described in aforesaid U.S. patent application Ser. No. 07/684,409.

All the Type I substrates in catalyst beds C, D, E and F had 64 cells per square inch, and all the Type II substrates had 60 cells per square inch. The washcoat loadings on the catalyst members of beds C, D, E and F was 1.5 g/in$^3$ in all cases. The configurations of beds C, D, E and F are summarized in TABLE IIA.

TABLE IIA

| Catalyst Member | Catalyst Bed C: Substrate Type, | Length | Washcoat |
|---|---|---|---|
| C1 | I | 1.5" | 8 wt. % Pd on alumina |
| C2 | I | 1" | 8 wt. % Pd; 10% ceria/-alumina |
| C3 | I | 1.5" | 7 wt. % $2La_2O_3.PdO$/93% alumina |
| C4 | I | 1.5" | alumina |

TABLE IIA-continued

| Catalyst Member | Catalyst Bed D: Substrate Type, Length | Washcoat |
|---|---|---|
| D1 | Same as C1 | Same as C1 |
| D2 | Same as C2 | Same as C2 |
| D3 | I 1.5" | alumina |
| D4 | I 1.5" | alumina |

| Catalyst Member | Catalyst Bed E: Substrate Type, Length | Washcoat |
|---|---|---|
| E1 | Same as C1 | Same as C1 |
| E2 | Same as C2 | Same as C2 |
| E3 | II 1.5" | alumina |
| E4 | II 1.5" | alumina |

| Catalyst Member | Catalyst Bed F: Substrate Type, Length | Washcoat |
|---|---|---|
| F1 | Same as C1 | Same as C1 |
| F2 | Same as C2 | Same as C2 |
| F3 | II 1.5" | 7 wt. % $2La_2O_3$.PdO/93% alumina |
| F4 | II 1.5" | alumina |

The efficacy of catalyst beds C, D, E and F were tested by placing them in a combustor to determine their respective initiation temperatures for a 4% methane in air combustion mixture at 3 atmospheres pressure. Two evaluations were performed for beds C and E, and three evaluations were made for catalyst beds D and F. The results are set forth below in TABLE IIB.

TABLE IIB

| Cat. Bed | Ignition Conditions: Inlet Temp. (°C.) | Init. Vel. (ft/s) | Fuel Conc. Vol. (%) | Extinction Temp. (°C.)/Fuel % |
|---|---|---|---|---|
| C | 480–500 | 50 | 4.0 | 462–480/4.0 |
| | 420 | 30 | 4.0 | |
| D | 487–550 | 50 | 4.1–3.75 | |
| | 530 | 60 | 4.0 | 496/4.0 |
| | 485–495 | 30 | 4.0 | 465–485/4.0 |
| E | 512 | 60 | 4.0 | 506/4.0 |
| | 550–578 | 50 | 4.0 | 515–520/4.0 |
| F | 475 | 60 | 4.0 | 452/4.0 |
| | 504–545 | 50 | 4.0 | 487–515/4.0 |
| | 472–477 | 30 | 4.0 | 440/4.0 |

The data of TABLE IIB show that catalyst beds E and F, which comprise Type II monoliths, provide catalytic activity comparable to that of catalyst beds C and D, which comprise only Type I monoliths throughout.

The foregoing catalyst beds C, D, E and F were aged by placing them in a combustor and passing a combustion mixture comprising 4% methane in air at an inlet linear velocity of 30 to 60 feet per second to initiate combustion for a period of 4 to 20 hours at 3 atmospheres pressure. Thereafter, samples of the spent catalyst members were examined by scanning electron microscope and compared against fresh (unaged) samples for visual evidence of deterioration. In some cases, samples were taken from both the inlet end and the outlet end of a particular catalyst member.

Figure 4A:
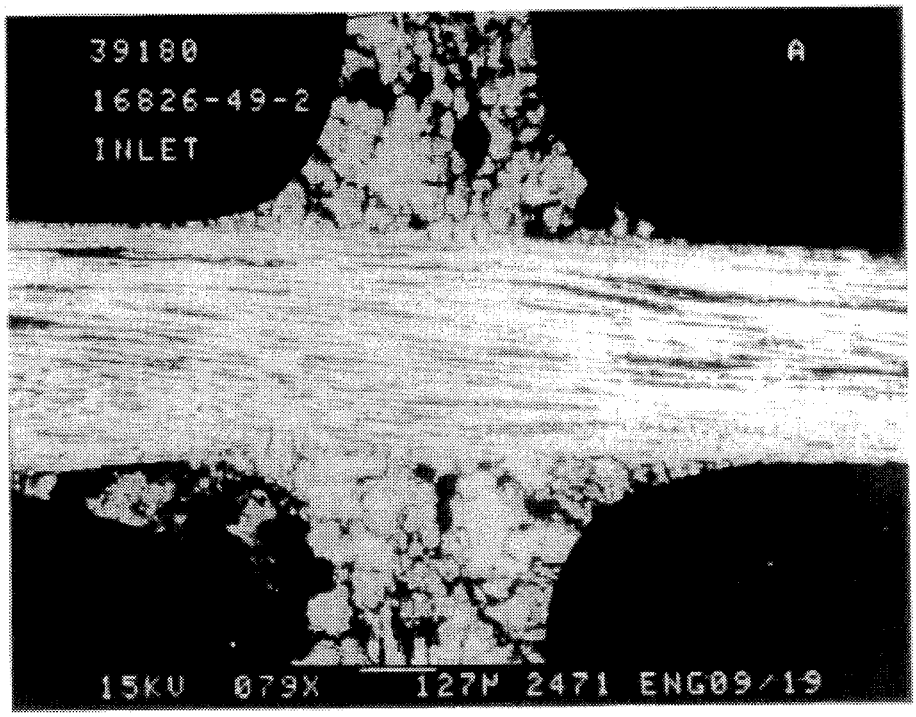
FIGS. 4A and 4B are SEM photographs of cross sections of inlet and outlet ends, respectively, of segment C3 of Example 2.
Figure 4B:
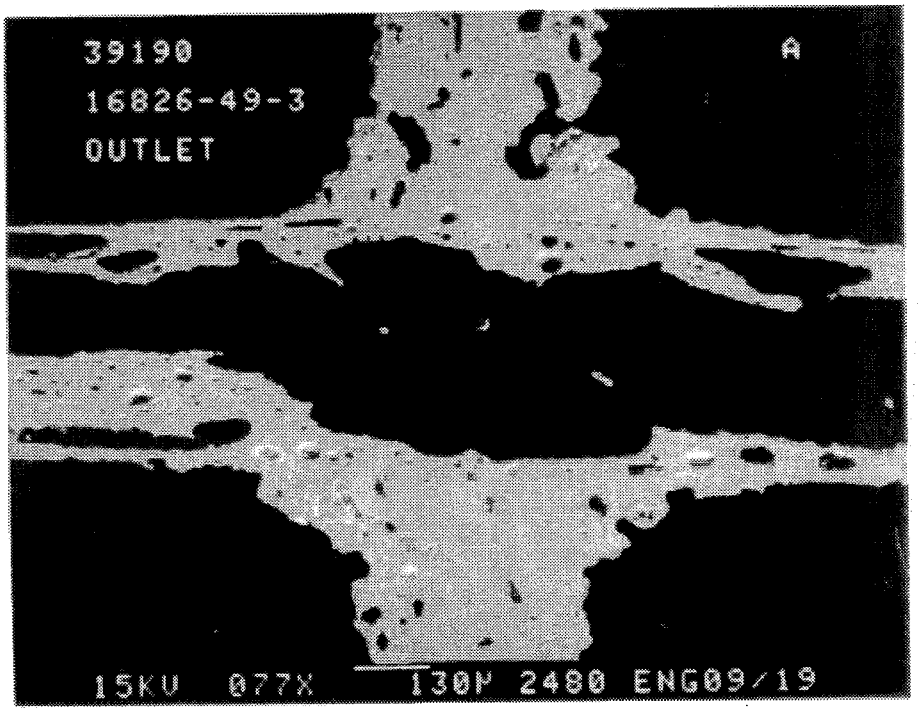
Figure 4C:
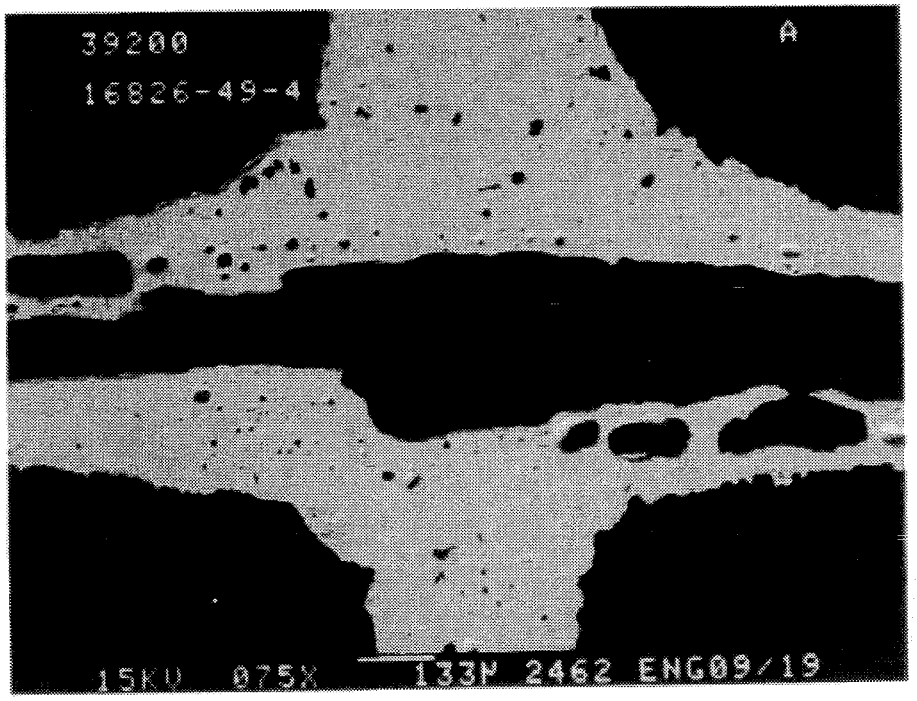
FIGS. 4C and 4D are SEM photographs of cross sections of spent and fresh spent samples, respectively, of segment C4 of Example 2.
Figure 4D:
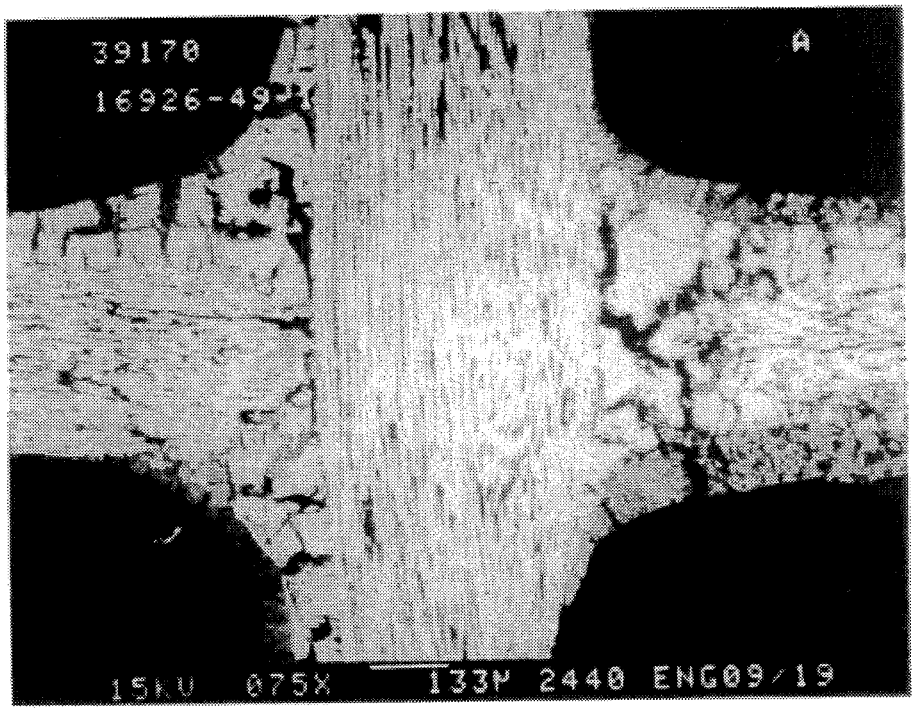

FIG. 4A and FIG. 4B are SEM photographs of a cross section of spent catalyst member C3 taken at the inlet and outlet ends, respectively, and clearly reveal that the outlet end of catalyst member C3 suffered greater deterioration than the inlet end. Energy Dispersion Spectroscopy ("EDS") showed a loss of palladium on the catalyst material of catalyst member C3. FIG. 4C is a SEM photograph of a cross section of the aged separator body C4 showing evidence of deterioration and washcoat-substrate interaction with the Type I substrate therein. FIG. 4D is a SEM photo of a cross section of an unused separator body of the same composition as separator body C4. FIGS. 4A–4D demonstrate that Type I substrates disposed in the downstream portion of the catalyst bed interact under operating conditions with the alumina-containing layer thereon, with a tendency toward greater interaction at more downstream positions.

Figure 5A:
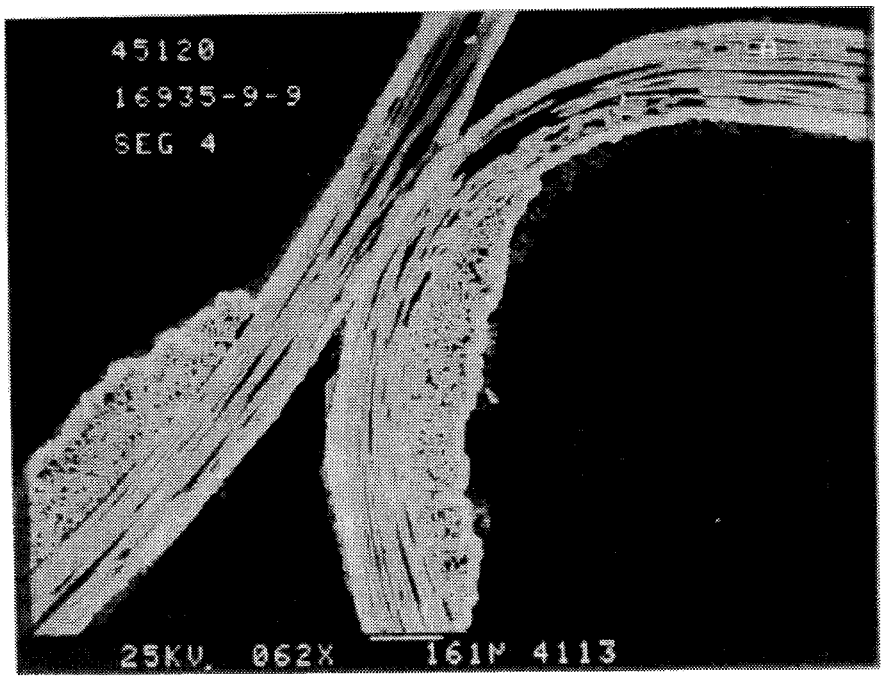
FIGS. 5A and 5B are SEM photographs of cross sections of spent segments E3 and E4 of Example 2, respectively.
Figure 5B:
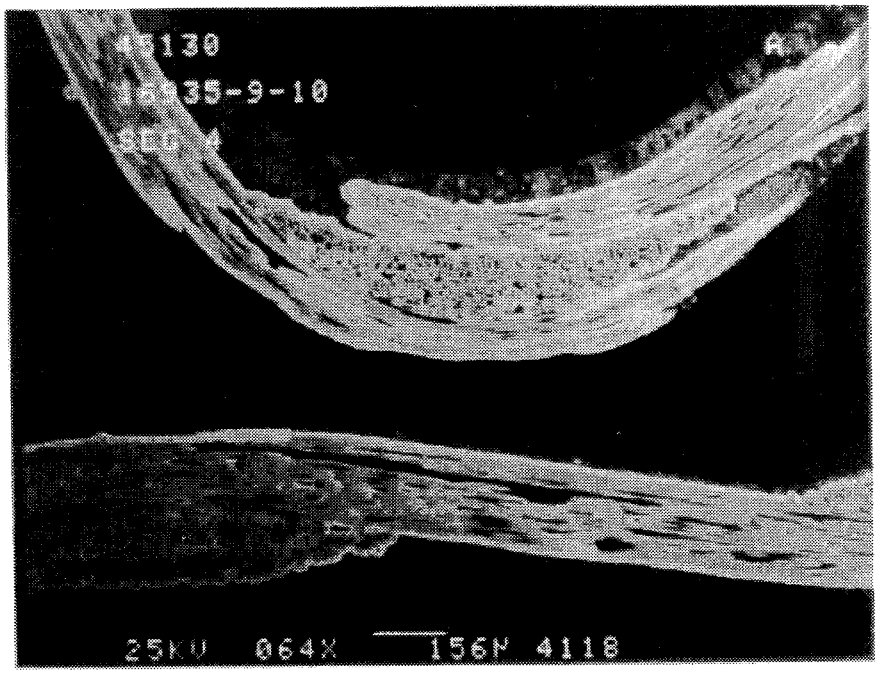

FIGS. 5A and 5B are SEM photographs of cross sections of separator bodies E3 and E4 showing little deterioration and alumina-containing coating material-substrate interaction.

Figure 6A:
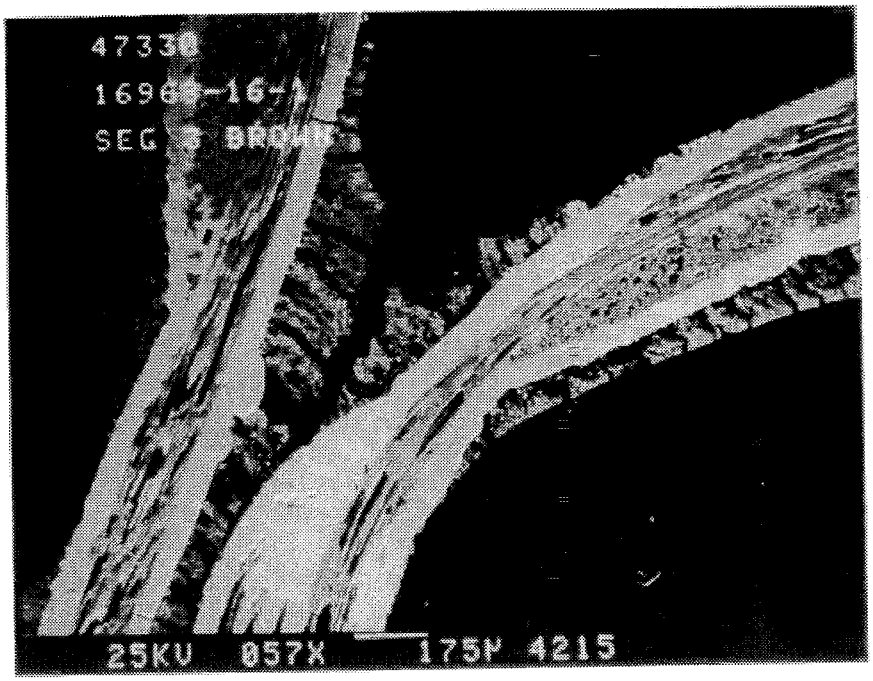
FIGS. 6A and 6B are SEM photographs of cross sections taken from the inlet and outlet ends, respectively, of spent segment F3 of Example 2.
Figure 6B:
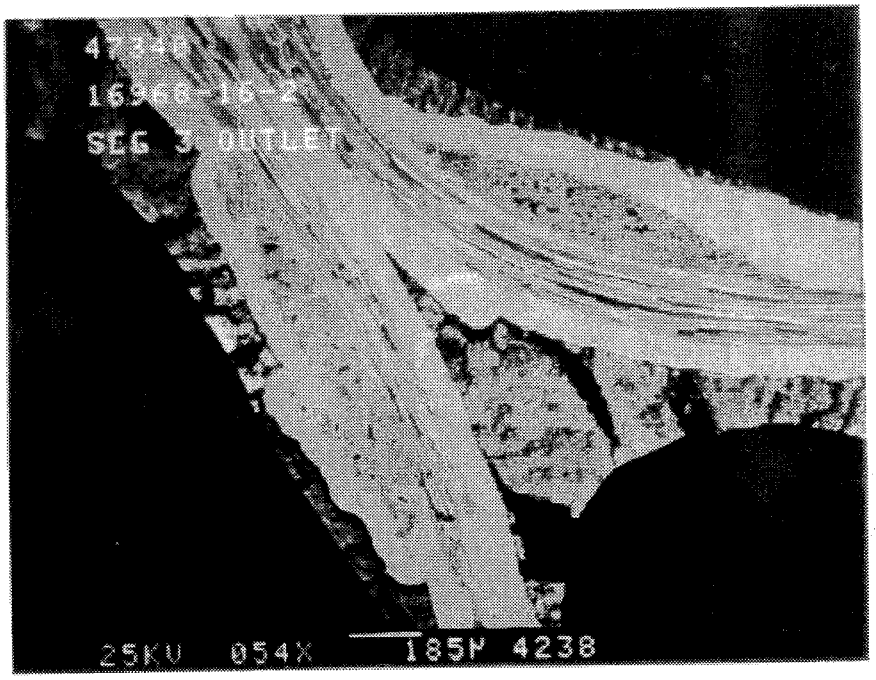

FIGS. 6A and 6B are SEM photographs of cross sections of the inlet and outlet ends of catalyst member F3 indicating that the structural integrity of segment F3 was not materially affected at either end. EDS analysis showed no significant loss of palladium from the washcoat at either end of this segment.

The foregoing description of beds E and F show not only that Type II monoliths function well as separator bodies, but that, surprisingly, Type II substrates exhibit better resistance to structural deterioration then Type I substrates. Therefore, there is a reduced chance that a separator body comprising a Type II substrate will fail physically under the stresses of combustor operation.

It is believed that the catalyst material on members C3 and F3 degraded during their respective combustor runs, and thus became catalytically inactive and were thus converted into separator bodies. Although the coatings on separator bodies generally do not include catalytic metals, e.g., platinum group metals, the deactivated 2 $La_2O_3$.PdO material provides a potential catalytic material that may be activated by exposure to conditions that allow the material to regenerate into a catalytically active compound. Further, it was apparent that member F3 retained more palladium than did member C3. Therefore, in the event that the upstream catalyst members failed and the catalyst beds cool sufficiently to allow the catalyst material on members C3 or F3 to regenerate, it is likely that bed F would show better performance after regeneration than bed C, due to the greater quantity of palladium retained on segment F3.

EXAMPLE 3

A catalyst bed H having two catalyst members was prepared utilizing Type I substrates in the 1st and 2nd positions and two separator bodies comprising Type II substrates in the 3rd and 4th positions. Catalyst member H1 had a catalyst material thereon comprising 8 weight percent palladium on alumina and was 1 inch in length. The catalyst material on catalyst member H2 comprised J weight percent palladium on alumina impregnated with 10 percent ceria, and had a length of 1.5 inches. Separator bodies H3 and H4 were both coated with lanthana- and baria-impregnated alumina and were 1.5 inches in length. The La-Ba alumina was prepared by impregnating the alumina with solutions of barium and lanthanum salts, and then drying and calcining the impregnated alumina to provide a support material comprising about 1.35% baria and about 1.85% lanthana by weight of the material. Other rare earth metals accompanied the lanthanum compound used to prepare this material so that the total rare earth oxides in the finished material comprised about 95% by weight lanthana and about 5% of oxides of other rare earth metals, typically ceria and neodymia. The Type I substrate had 64 cells per square inch; the Type II substrates had 60 triangular cells per square inch.

The configuration of bed H is summarized in TABLE IIIA below.

TABLE IIIA

| Catalyst | Catalyst Bed HC | | |
|---|---|---|---|
| | Substrate | | |
| Member | Type, | Length | Washcoat |
| H1 | I | 1" | 8 wt. % Pd on alumina |
| H2 | I | 1.5" | 4 wt. % Pd on 10% ceria/-alumina |
| H3 | II | 1.5" | La—Ba alumina |
| H4 | II | 1.5" | La—Ba alumina |

When fresh, catalyst members H1 and H2 had a brown color; separator bodies H3 and H4 were white.

Before bed H was assembled, segments H1 and H2 were placed in a preliminary combustor bed in which segments 3 and 4 were separator bodies having a coating of alumina thereon. The preliminary bed experienced 10 ignitions and was subjected to 12.75 hours of on-stream time, yielding 6.25 hours of complete combustion. Separately, segments H3 and H4 were placed in the downstream positions of a different preliminary bed which experienced 5 ignitions in 2.75 hours of on-stream time but no complete combustion. Subsequently, segments H3 and H4 were used in still another preliminary bed which experienced 6 ignitions in 5.5 hours of on-stream time, yielding 1.75 hours of complete combustion.

Following the preliminary combustion runs, bed H was assembled in a combustion test unit which was operated at 1 atmosphere pressure. The approach velocity of the gas stream was 17 m/sec (56 ft/sec), and the combustion mixture was about 4 to about 5.2 volume percent methane in air. The bed experienced 1 ignition, 3.2 hours of on-stream time and 2.0 hours of complete combustion. Combustion was ignited at 537° C. at a combustion mixture methane content of 4.2 volume percent. Following ignition, the inlet temperature and volume percent fuel were varied to determine the performance of the bed under various conditions. The inlet velocity and pressure were steadily maintained. The performance data, including temperature measurements made downstream of segment H1, segment H2 and at a point 6 inches downstream of the catalyst bed, are summarized in TABLE IIIB.

TABLE IIIB

| Inlet | Inlet | H1* Exit | H2* Exit | 6 Inch Down-Stream | Effluent Components | | | Outlet |
|---|---|---|---|---|---|---|---|---|
| Temp (°C.) | CH (V %) | Temp (°C.) | Temp (°C.) | Temp (°C.) | $NO_x$ (ppm) | CO (ppm) | UHC[1] (ppm) | $O_2$ (V %) |
| 537 | 4.2 | 614 | 684 | 1340 | 1.7 | 52 | 9.7 | 12.5 |
| 525 | 4.2 | 607 | 676 | 1331 | 1.7 | 54 | 8.6 | 12.4 |
| 522 | 4.3 | 604 | 678 | 1407 | 1.9 | 54 | 8.6 | 12.4 |
| 522 | 4.3 | 600 | 674 | 1390 | 1.7 | 54 | 6.9 | 12.4 |
| 500 | 4.4 | 576 | 654 | 1426 | 1.9 | 40 | 6.7 | 12.3 |
| 478 | 4.4 | 554 | 646 | 1400 | 3.1 | 30 | 6.0 | 12.4 |
| 431 | 4.5 | 530 | 626 | 1407 | 2.9 | 42 | 0.3 | 12.2 |
| 414 | 4.7 | 515 | 615 | 1423 | 3.1 | 38 | 0.0 | 11.9 |
| 397 | 4.9 | 492 | 601 | 1431 | 3.4 | 40 | 0.0 | 11.7 |
| 403 | 5.2 | 491 | 608 | 1500 | 6.0 | 76 | 0.0 | 10.8 |

[1]UHC stands for unburned hydrocarbons

*The values given for H1 and H2 exit temperature are the average of two measurements taken at the exit of each piece.

The attainment of ignition and complete combustion and the data of TABLE IIIB show that segments H1 and H2 were effective in bed H to catalyze the combustion of the air-fuel mixture despite their prior combustion runs, and thus demonstrate that the separator bodies used downstream of segments H1 and H2 in those prior runs effectively protected these segments from exposure to deactivating temperatures.

Catalyst Activity

Two test cores measuring 0.75 inches in diameter and 0.5 inches in length were taken from the inlet and outlet ends of spent catalyst members H1 and H2. A similar test core was taken from a fresh catalyst member of each type. The activity of the samples was measured in the manner described above in Example 2 and the results are set forth in TABLE IIIC below.

TABLE IIIC

| Catalyst | Temp. (°C.) at % $CH_4$ Conversion | | | | |
|---|---|---|---|---|---|
| Member | 10% | 20% | 30% | 40% | 50% |
| Segment H1 (8% $Pd/Al_2O_3$) | | | | | |
| fresh | 340 | 370 | 403 | 463 | 592 700(55%) |
| spent inlet (i) | 405 | 459 | 508 | 559 | 625 700(55%) |
| spent inlet (ii) | 422 | 495 | 552 | 603 | 670 700(54%) |
| spent outlet (i) | 410 | 460 | 511 | 564 | 630 700(55%) |
| spent outlet (ii) | 431 | 498 | 555 | 607 | 678 700(53%) |

TABLE IIIC-continued

| Catalyst Member | Temp. (°C.) at % $CH_4$ Conversion 10% | 20% | 30% | 40% | 50% |
|---|---|---|---|---|---|
| Segment H2 (4% Pd, 10%$CeO_2$/$Al_2O_3$) | | | | | |
| fresh | 390 | 451 | 517 | 598 | 700(44%) |
| spent inlet (i) | 420 | 501 | 550 | 652 | 700(40%) |
| spent inlet (ii) | 454 | 526 | 594 | 683 | 700(41%) |
| spent outlet (i) | 471 | 543 | 601 | 687 | 700(41%) |
| spent outlet (ii) | 480 | 550 | 613 | 690 | 700(41%) |

The data of TABLE IIIC show that the inlet and outlet portions of catalyst member H1 show roughly the same degree of deactivation after a combustion cycle. The outlet portion of catalyst member H2 was more greatly deactivated than the inlet portion.

Structural Integrity

Figure 7A:
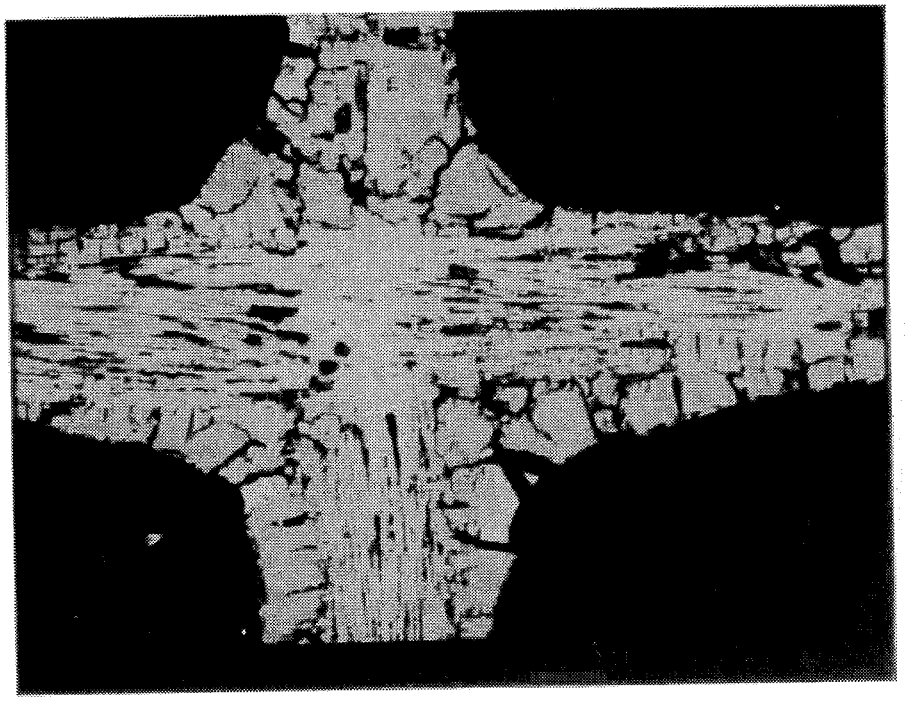
FIGS. 7A and 7B are SEM photographs of cross sections taken from the inlet and outlet ends, respectively, of segment H1 of Example 3.
Figure 7B:
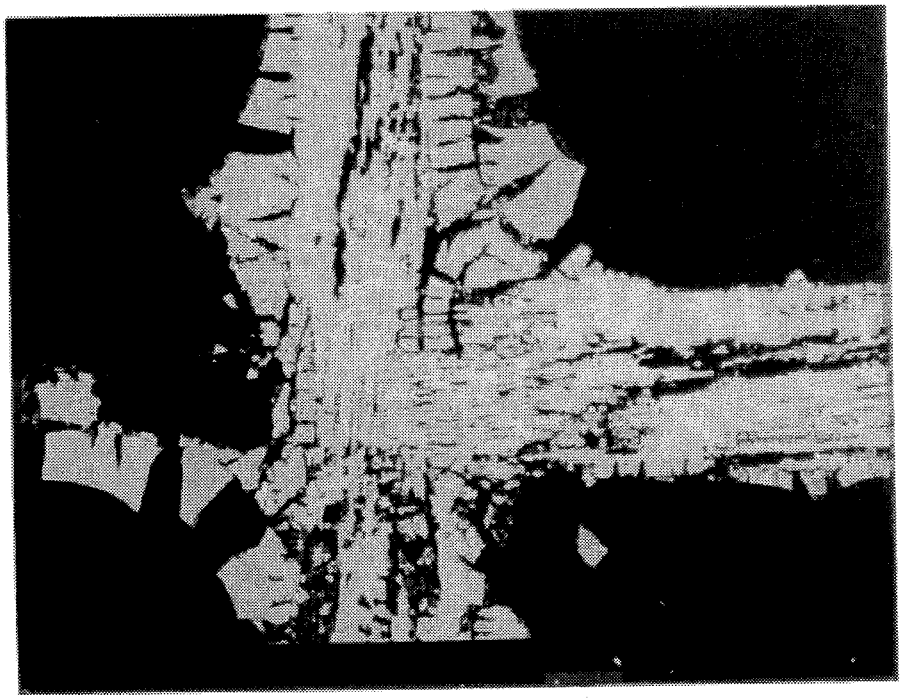
Figure 7C:
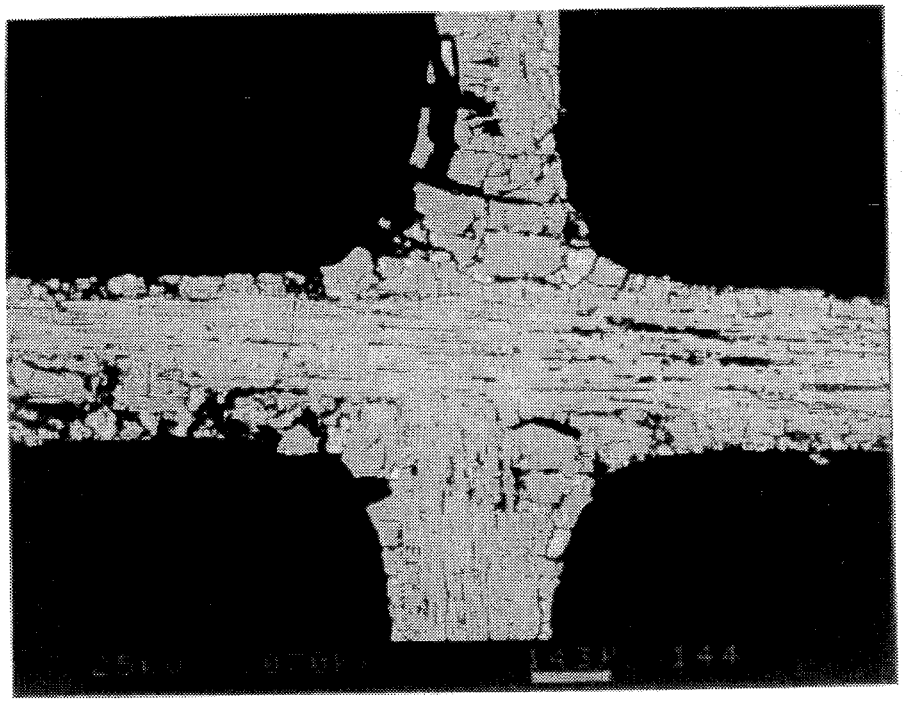
FIGS. 7C and 7D are SEM photographs of cross sections of spent segment H2 of Example 3.
Figure 7D:
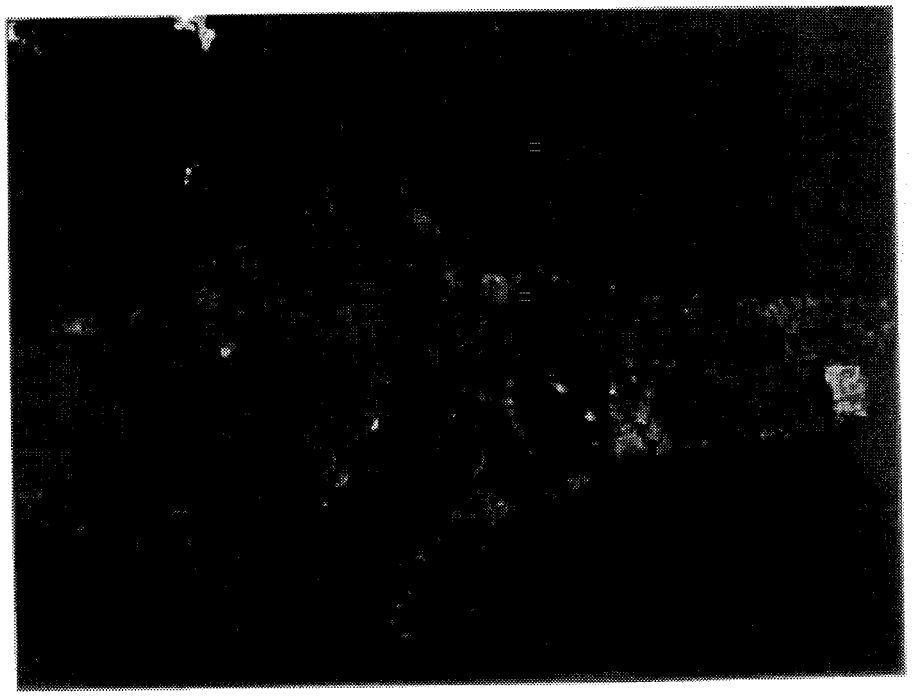
Figure 7E:
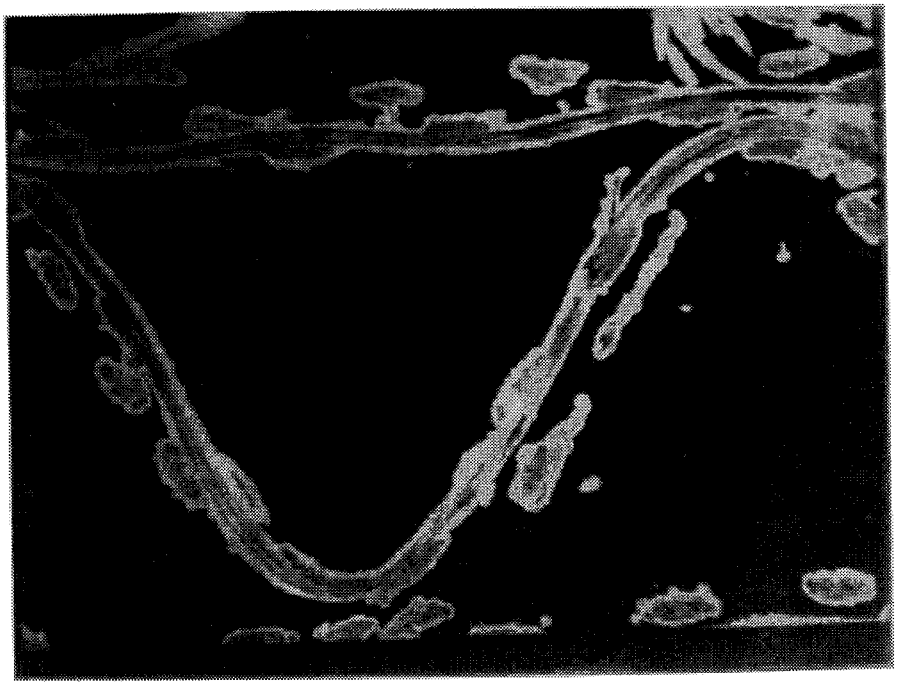
FIGS. 7E and 7F are SEM photographs of cross sections taken from the inlet and outlet ends, respectively, of segment H3 of Example 3.
Figure 7F:
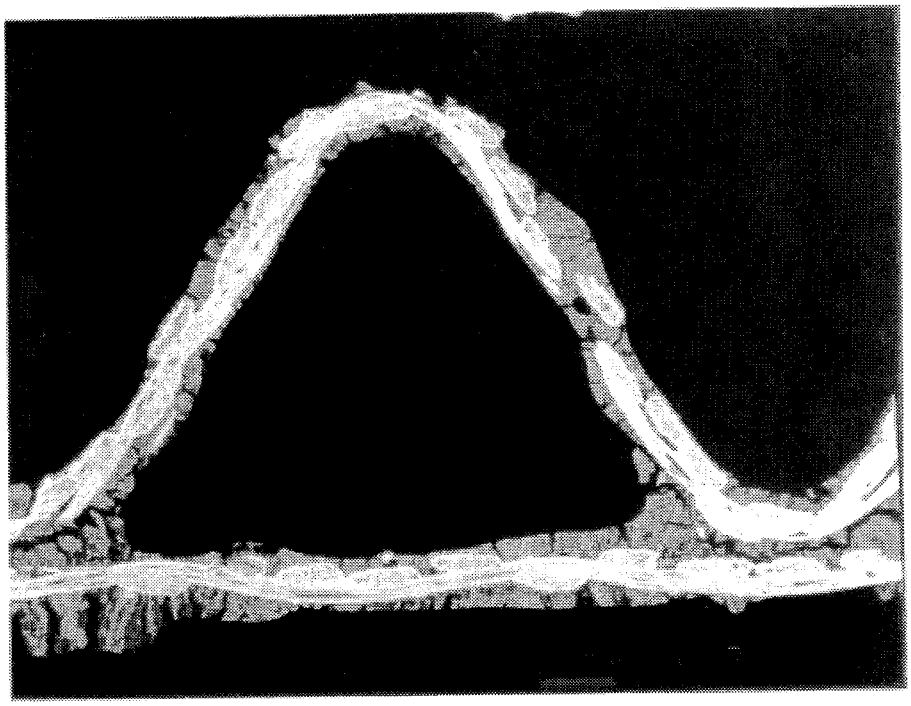
Figure 7G:
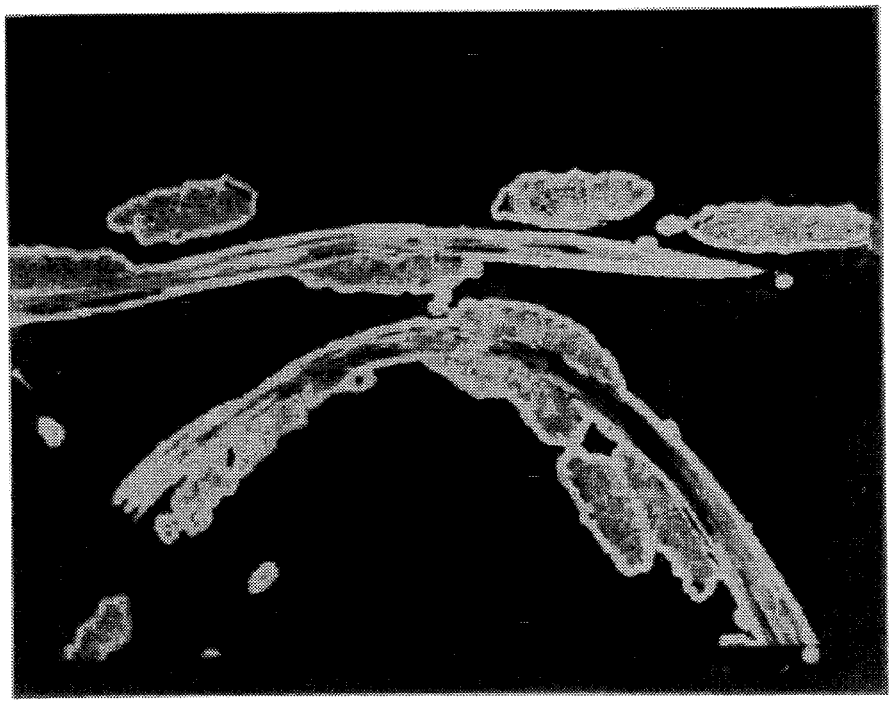
FIGS. 7G and 7H are SEM photographs of cross sections taken from the inlet and outlet ends, respectively, of segment H4 of Example 3.
Figure 7H:
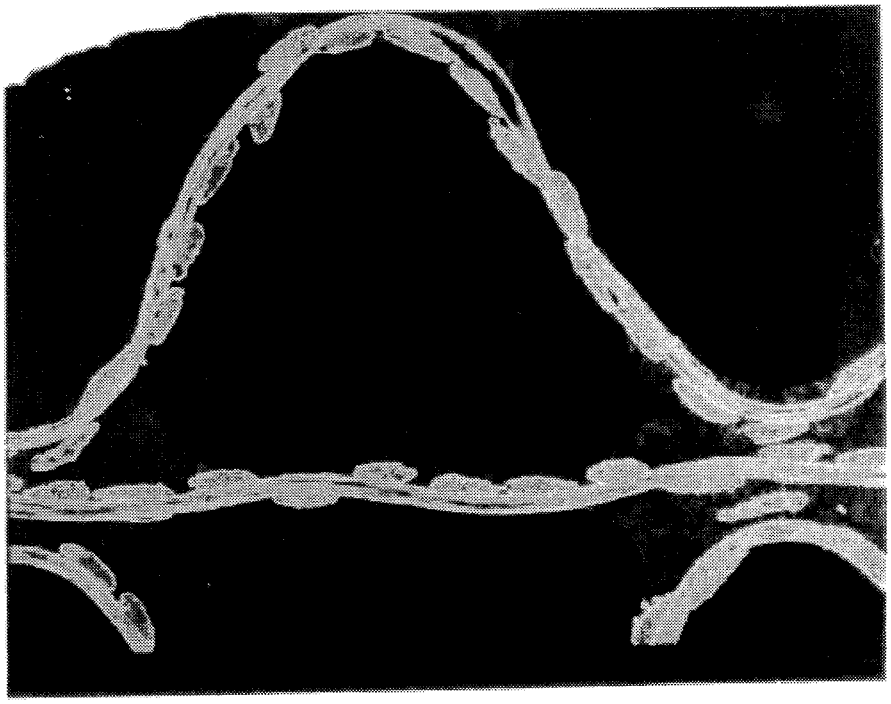

SEM photographs of cross-sections taken from the inlet and outlet ends of spent catalyst members H1 and H2 are shown in FIGS. 7A and 7B (Segment H1) and 7C and 7D (Segment H2), respectively. These photos show very little deterioration in catalyst members H1 and H2 indicating the efficacy of separator bodies H3 and H4, which also showed good washcoat retention and good substrate integrity, as seen in FIGS. 7E, 7F and 7G, 7H.

The post run activity data of TABLE IIIC and the foregoing structural integrity study show that the use of separator bodies H3 and H4 effectively shielded catalyst members H1 and H2 upstream thereof from thermal degradation. The structural integrity results also show that separator bodies comprising Type II monoliths resist detrimental interaction with a washcoat thereon, thus better preserving their mechanical strength.

While the invention has been described with reference to particular embodiments thereof, it will be appreciated that numerous variations to the described embodiments will be within the scope of the appended claims.

What is claimed is:

1. A combustor for catalytically promoting thermal combustion of an inlet combustion gas mixture flowed sequentially through an upstream zone and then a downstream zone of the combustor, the combustor comprising: a catalyst body disposed in the upstream zone and comprising a plurality of catalyst members comprising a carrier having a plurality of gas flow channels extending therethrough defined by channel walls, the channel walls of the carrier having disposed thereon a catalyst composition effective for promoting combustion of the combustion gas mixture and wherein each catalyst member abuts the catalyst member or members adjacent to it; a separator body disposed in the upstream zone in a position downstream of the catalyst body, wherein the catalyst body and the separator body comprise discrete bodies and wherein the most downstream catalyst member abuts the separator body; and a homogeneous reaction zone disposed within the downstream zone; the separator body being dimensioned and configured to thermally shield the catalyst body from the homogeneous reaction zone.

2. The combustor of claim 1 wherein the catalyst body and the separator body comprise discrete bodies disposed in proximity to each other.

3. The combustor of claim 1 wherein the catalyst body and the separator body are disposed in abutting contact with each other.

4. The combustor of claim 2 wherein the catalyst body and the separator body are of substantially identical cross-sectional area and configuration.

5. The combustor of claim 2 or 3 wherein the catalyst composition comprises a palladium oxide catalyst composition.

6. The combustor of claim 5 wherein the separator body is substantially free of a metal-containing catalyst effective for catalytically promoting thermal combustion of the inlet combustion gas mixture.

7. The combustor of claim 1 wherein each catalyst member is in proximal relation to the catalyst member or members adjacent to it and the most downstream catalyst member is in proximal relation to the separator body.

8. The combustor of claim 1 wherein each of the catalyst members and the separator body contains from 9 to 400 of the gas flow channels per square inch of cross-sectional area ("cpsi").

9. The combustor of claim 1 or 6 wherein the total combined length of catalyst members is from about ½ to 12 inches, and the length of the separator body is from about ½ to 5 inches.

10. The combustor of claim 1 or 6 wherein the separator body comprises at least one of (i) a silica-magnesia-alumina material comprised primarily of cordierite, mullite and corundum, and (ii) a ceramic fiber matrix material comprising ceramic fibers, the composition of which comprises alumina, boron oxide and silica, the fibers being fixed in a silicon carbide matrix.

11. The combustor of claim 9 wherein the silica-magnesia-alumina material comprises about 20 to 40 weight percent $SiO_2$, about 3 to 6 weight percent MgO and about 54 to 77 weight percent $Al_2O_3$, with from about 50 to 90 percent by weight of each of said $SiO_2$, MgO and $Al_2O_3$ comprising crystalline material, the balance comprising amorphous material.

12. The combustor of claim 11 wherein the crystalline material comprises about 15 to 40 percent by weight cordierite, about 15 to 35 percent by weight corundum and about 10 to 30 percent by weight mullite by weight of the carrier.

13. The combustor of claim 12 wherein the fibers of the ceramic fiber matrix material comprises about 64 percent alumina, 14 percent $B_2O_3$ and 24 percent $SiO_2$.

14. The combustor of claim 1 wherein the catalyst body comprises a plurality of catalyst members and wherein the catalyst composition comprises palladium oxide dispersed on a refractory inorganic oxide support.

15. The combustor of claim 14 wherein the refractory inorganic oxide support comprises alumina.

16. The combustor of claim 15 wherein the alumina support is impregnated with a rare earth oxide.

17. The combustor of claim 1 or claim 14 wherein the separator body has disposed thereon a coating of a material that is substantially inactive for the combustion of the combustion gas mixture under ordinary separator body operating conditions.

18. The combustor of claim 13 wherein the coating on the separator body comprises alumina.

19. The combustor of claim 17 wherein the coating comprises a binary oxide of a rare earth metal and palladium that is substantially inactive at separator body normal operating temperatures.

20. The combustor of claim 1 or 6 wherein the separator body comprises a ceramic fiber matrix material comprising ceramic fibers, the composition of which comprises alumina, boron oxide and silica, the fibers being fixed in a silicon carbide matrix.

21. The combustor of claim 17 wherein the fibers of the ceramic fiber matrix material comprises about 64 percent alumina, 14 percent $B_2O_3$ and 24 percent $SiO_2$.

* * * * *